US005999776A

United States Patent [19]

Abe et al.

[11] Patent Number: 5,999,776

[45] Date of Patent: Dec. 7, 1999

[54] CONTACT CHARGING MEMBER, IMAGE FORMING UNIT INCLUDING THE CONTACT CHARGING MEMBER AND ELECTROPHOTOGRAPHIC IMAGE FORMING APPARATUS INCLUDING THE IMAGE FORMING UNIT

[75] Inventors: Tetsuya Abe, Tama; Masaki Kanasugi, Kodaira; Takao Yorifuji; Noriki Ono, both of Higashiyamato; Moriyuki Kouroku, Higashimurayama, all of Japan

[73] Assignees: Casio Computer Co., Ltd.; Casio Electronics Manufacturing Co., Ltd., both of Tokyo, Japan

[21] Appl. No.: 09/063,694

[22] Filed: Apr. 21, 1998

[30] Foreign Application Priority Data

Oct. 22, 1997 [JP] Japan ..... 9-290176

[51] Int. Cl.[6] ..... G03G 15/02

[52] U.S. Cl. ..... 399/176

[58] Field of Search ..... 399/176, 174, 399/175

[56] References Cited

U.S. PATENT DOCUMENTS 5,294,962 3/1994 Sato et al. .

5,402,213 3/1995 Ikegawa et al. ..... 399/174

5,713,067 1/1998 Mizoe et al. ..... 399/176

FOREIGN PATENT DOCUMENTS 2632899 4/1997 Japan .

*Primary Examiner*—Arthur T. Grimley
*Assistant Examiner*—William A Noe
*Attorney, Agent, or Firm*—Frishauf, Holtz, Goodman, Langer & Chick

[57] ABSTRACT

A roller-shaped contact charging member which is in contact with and electrically charges a photosensitive drum is provided on a center shaft, and includes a roller-shaped conductive foam material portion covering the shaft, and a tubular-shaped conductive resin material portion covering the foam portion. The foam portion has an electric resistance of $9\times10^5$ Ω or less, the resin portion includes conductive agents and has a surface electric resistance in a range from $1\times10^5$ Ω/□ or more to $9\times10^7$ Ω/□ or less, and a hardness of the charging roller as a whole is Asker F 90° or less. An image forming unit includes the charging member and the drum. An electrophotographic image forming apparatus supplies a recording paper to the unit, transfers an image from the drum to the paper, and discharges the image-transferred paper.

12 Claims, 9 Drawing Sheets

○: PRINTING QUALITY IS GOOD

×: PRINTING QUALITY IS BAD

| AMOUNT OF BITE | 0mm | 0.2mm | 0.4mm | 0.7mm |
|---|---|---|---|---|
| ASKER-F80° | × | ○ | ○ | ○ |
| ASKER-C45° | × MANY WHITE SPOTS | × | × | × LARGE GAP |

FIG.4A

| SURFACE RESISTANCE OF TUBE (Ω/□) / RESISTANCE OF FOAM MATERIAL (Ω) | $10^5$ | $10^6$ | $10^7$ | $10^8$ | $10^9$ |
|---|---|---|---|---|---|
| $10^1$ | ○ | ○ | ○ | △ | × |
| $10^2$ | ○ | ○ | ○ | △ | × |
| $10^3$ | ○ | ○ | ○ | △ | × |
| $10^4$ | ○ | ○ | ○ | △ | × |
| $10^5$ | ○ | △ | △ | △ | × |
| $10^6$ | × | × | × | × | × |

○: CHARGING CHARACTERISTIC OF CHARGING ROLLER 11 IS GOOD

△: CHARGING CHARACTERISTIC OF CHARGING ROLLER 11 IS RATHER BAD

×: CHARGING CHARACTERISTIC OF CHARGING ROLLER 11 IS BAD

FIG.4B

CONTACT CHARGING MEMBER, IMAGE FORMING UNIT INCLUDING THE CONTACT CHARGING MEMBER AND ELECTROPHOTOGRAPHIC IMAGE FORMING APPARATUS INCLUDING THE IMAGE FORMING UNIT

BACKGROUND OF THE INVENTION

This invention relates to a contact charging member which electrically charges a member, an image forming unit including the contact charging member, and an electrophotographic image forming apparatus including the image forming unit, the apparatus including a printer, a copier, and the like.

A corona discharger has been widely used as an electric charger for uniformly charging an image carrier, for example a photosensitive drum of the image forming unit of the electrophotographic image forming apparatus. Recently, the corona discharger, however, is not widely used because it generates a lot of ozone harmful to a working environment. Instead of the corona discharger, a contact charging brush and a contact charging roller have come into use.

FIG. 7A shows a conventional charging brush 1 which is known from U.S. Pat. No. 5,294,962 and FIG. 7B shows a conventional charging roller 4 which is known from Japanese Patent No. 2,632,899.

The charging brush 1 is formed by sticking a base cloth 1*b* to a conductive base plate 1*d* with a conductive adhesive 1*c*, and the base cloth 1*b* has a large number of conductive bristles 1*a* planted thereon. A high-voltage power supply 2 applies a high voltage, for example about 1 kv, to the conductive base plate 1*d* and the conductive bristles 1*a* of the base cloth 1*b* bring their tips into contact with a cylindrical surface of a photosensitive drum 3 so that the surface of the drum is charged uniformly.

The charging roller 4 is formed by providing a conductive rubber layer 4*b* being relatively hard on a metal rod 4*a* and further providing a relatively high-resistance surface layer 4*c* on an outer surface of the rubber layer 4*b*. The metal rod 4*a* is applied with a high voltage by the high-voltage power supply 2, and a bottom end of a cylindrical surface of the charging roller 4 is pressed against the cylindrical surface of the drum 3 so that the cylindrical surface of the drum is charged uniformly.

According to the above described Japanese Patent, the hardness of the charging roller 4 is indicated by Asker C 54.5°, the surface layer 4*c* is formed by coating nylon resin to 10 $\mu$m in thickness, and a volume resistivity of the charging roller 4 is $10^9$ to $10^{10}$ Ω·cm.

The charging brush has such a problem that it tends to become dirty with dust or remaining toner attached on the surface of the photosensitive drum, and the attached dust or toner is hard to remove. Further, the dirty charging brush sometimes presents an unstable charging characteristic. For this reason, charging rollers have begun to attract the attention of those who work in this technical field.

In order to obtain a good image by using the charging roller, pressure applied to both ends of the metal rod must be uniformly distributed along the entire length of the rod so that the roller is pressed against the photosensitive drum uniformly. If there is a slight nonuniformity of charging on the drum, it causes a distinctive irregularity in a toner image formed on the photosensitive drum and lowers a quality of the image because a resolution of an image to be formed have been improved in recent years and toner particles have been made much finer.

In order to uniformly distribute the pressure applied to the both ends of the metal rod along its entire length in such a charging roller having a relatively hard conductive rubber layer, an outer diameter of the metal rod must be made large.

The largest image formed by a conventional desktop type image forming apparatus corresponds to a paper sheet of A4 size (210 mm×297 mm) defined by JIS (Japanese Industrial Standard) P0138. Recently, however, it is strongly demanded to form an image corresponding to a paper sheet of A3 size (two times as large as the A4 size) defined by JIS P0138, by the desktop type image forming apparatus. To meet this demand, the photosensitive drum must be made longer and consequently the charging roller must be larger. This makes the outer diameter of the metal rod and that of the charging roller larger, further makes the outer sizes of the image forming unit and those of the image forming apparatus larger. As a result of this, in a modern desktop type image forming apparatus wherein an image forming unit is rotatably separable in a vertical direction from the remaining members of the apparatus so that apparatus maintenance can be easily performed, it becomes difficult to open the image forming unit.

To prevent the outer dimension of the unit and those of the apparatus from becoming larger, the inventors of the present invention prepared such a small charging roller which had an outer diameter of 10 mm and a surface hardness of Asker C 45°, a metal rod of which had a diameter of 6 mm and a rubber layer of which had a thickness of 2 mm. And, the inventors operated an image forming apparatus provided with an image forming unit using the small charging roller. As a result of this operation, the small charging roller could not be substantially uniformly pressed against the photosensitive drum. Specifically, when a force pressing the charging roller against the circular surface of the photosensitive drum was increased, the charging roller bent to separate its longitudinal center portion from the surface of the photosensitive drum so that an image formed on a recording medium, for example a paper sheet, by the apparatus had a defect at. its portion corresponding to a longitudinal center portion of the surface of the drum from which the longitudinal center portion of the bent small charging roller was separated. When the force pressing the charging roller against the cylindrical surface of the photosensitive drum was decreased, the image formed on the sheet by the apparatus had many white spots.

This invention derived from the above described circumstances, and an object of the present invention is to provide a contact charging member which can not only charge a member uniformly but also be compact and has a long life time, an image forming unit including the contact charging member, and an electrophotographic image forming apparatus including the image forming unit.

BRIEF SUMMARY OF THE INVENTION

In order to achieve the above described object, a contact charging member of this invention is provided on a center member and comprises a conductive foam material portion covering the center member, and a conductive resin material portion covering the conductive foam material portion and being used to be in contact with a member to be charged, the conductive foam material portion having an electric resistance of $9\times10^5$ Ω or less, the conductive resin material portion including conductive agents and having a surface electric resistance in a range from $1\times10^5$ Ω/□ or more to $9\times10^7$ Ω/□ or less, and a hardness of the contact charging member being Asker F 90° or less.

In the contact charging member of the present invention characterized by the above configuration, the conductive foam material portion may have a roller-shape, the conductive resin material portion may have a tubular-shape, and the contact charging member may have a roller-shape. The member to be charged may be an image carrier including a surface having an image formation area on which an image is formed and image-free areas arranged outside of the image formation area, the tubular-shaped conductive resin material portion preferably has both ends corresponding to the image-free areas of the image carrier and preferably is fixed at both ends to the roller-shaped conductive foam material portion by an adhesive.

To achieve the above described object of the present invention, an image forming unit of the present invention comprises an image carrier and a contact charging member which is in contact with a surface of the image carrier and electrically charges the surface of the image carrier uniformly, the contact charging member being provided on a center member and including a conductive foam material portion which covers the center member, and a conductive resin material portion which covers the conductive foam material portion and is in contact with the surface of the image carrier, the conductive foam material portion having an electric resistance of $9\times10^5$ Ω or less, the conductive resin material portion including conductive agents and having a surface electric resistance in a range from $1\times10^5$ Ω/□ or more to $9\times10^7$ Ω/□ or less, and a hardness of the contact charging member being Asker F 90° or less.

In the image forming unit of the present invention characterized by the above described configuration, the conductive foam material portion may have a roller-shape, the conductive resin material portion may have a tubular-shape, and the contact charging member may have a roller-shape. The image carrier may includes a surface having an image formation area on which an image is formed and an image-free areas arranged in both outside the image formation area, the turbular-shaped conductive resin material portion preferably has both ends corresponding to the image-free areas of the image carrier and preferably is fixed at both ends to the roller-shaped conductive foam material portion by an adhesive.

The image carrier preferably has a drum shape and is rotatably driven, and the roller-shaped contact charging member preferably brings the conductive resin material portion into contact with the surface of the image carrier so that the charging member may be rotated by the rotation of the image carrier.

In the image forming unit of the present invention characterized by the above described configuration, the image carrier includes an aluminum drum having an anodized aluminum layer provided on an outer surface thereof and a photosensitive material layer provided on the anodized aluminum layer.

To achieve the above described object of the present invention, an electrophotographic image forming apparatus of the present invention comprises an image carrier which includes a photosensitive drum having a cylindrical surface, a roller-shaped contact charging member which is in contact with the circular surface of the photosensitive drum and electrically charges the surface of the drum uniformly, an exposure device which exposes the uniformly charged surface of the drum with a desired image, a developing device which develops the exposed desired image on the surface of the drum, a recording medium supply device which supplies a recording medium toward the developed desired image on the surface of the drum, a transfer device which transfers the developed desired image from the surface of the drum to the supplied recording medium, and a recording medium discharge device which discharges the recording medium with the transferred developed desired image from the surface of the drum, the roller-shaped contact charging member being provided on a center member and including a roller-shaped conductive foam material portion which covers the center member and has an electric resistance of $9\times10^5$ Ω or less, and a tubular-shaped conductive resin material portion which covers the conductive foam material portion, is in contact with the surface of the photosensitive drum, includes conductive agents and has a surface electric resistance in a range from $1\times10^5$ Ω/□ or more to $9\times10^7$ Ω/□ or less, and the hardness of the contact charging member being Asker F 90° or less.

In the electrophotographic image forming apparatus of the present invention characterized by the above described configuration, the surface of the photosensitive drum has an image formation area on which an image is formed and an image-free area outside of the image formation area, the tubular-shaped conductive resin material portion of the roller-shaped contact charging member may have both ends corresponding to the image-free areas of the drum and may be fixed at the-both ends to the roller-shaped conductive foam material portion of the roller-shaped contact charging member by an adhesive.

In the electrophotographic image forming apparatus of the present invention characterized by the above described configuration, the photosensitive drum is rotatably driven, and the roller-shaped contact charging member may be rotated by the rotation of the photosensitive drum through friction produced between the surface of the conductive resin material portion of the roller-shaped contact charging member and that of the photosensitive drum.

In the electrophotographic image forming apparatus of the present invention characterized by the above described configuration, the photosensitive drum preferably includes an anodized aluminum layer provided on an outer surface thereof and a photosensitive material layer provided on the anodized aluminum layer.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinbefore.

BRIEF DESCRIPTION OF THE SEVERAL VIEWS OF THE DRAWING

An embodiment of the present invention and a modification thereof will now be described in more detail with reference to the following drawings in which:

FIG. 4A is a table in which changes in the image quality achieved by the image forming unit using the contact charging roller as the contact charging member according to one embodiment of the present invention, and the image quality achieved by the conventional image forming unit using the conventional contact charging roller as the contact charging member, are shown, those changes being caused by changing an amount of bite of the contact charging roller to the photosensitive drum in each of the unit of the present invention and the conventional unit;

FIG. 4B is a table in which changes in the image quality achieved by the image forming unit using the contact charging roller as the contact charging member according to one embodiment of the present invention is shown, those changes being caused by changing a resistance of a conductive foam material portion covering a center rod member in the contact charging roller and by changing a surface resistance of a tube of a conductive resin material portion covering the foam material portion in the contact charging roller;

DETAILED DESCRIPTION OF THE INVENTION

A contact charging roller as a contact charging member according to one embodiment of the present invention, image forming units using the contact charging roller of the one embodiment of the present invention and using that of a modification thereof, and an image forming apparatus using a plurality of the units will be described in detail with reference to FIGS. 1A to 6B in the accompanying drawings.

First, the electrophotographic image forming apparatus and the image forming unit will be described in detail with reference to FIGS. 6A and 6B.

Figure 6A:
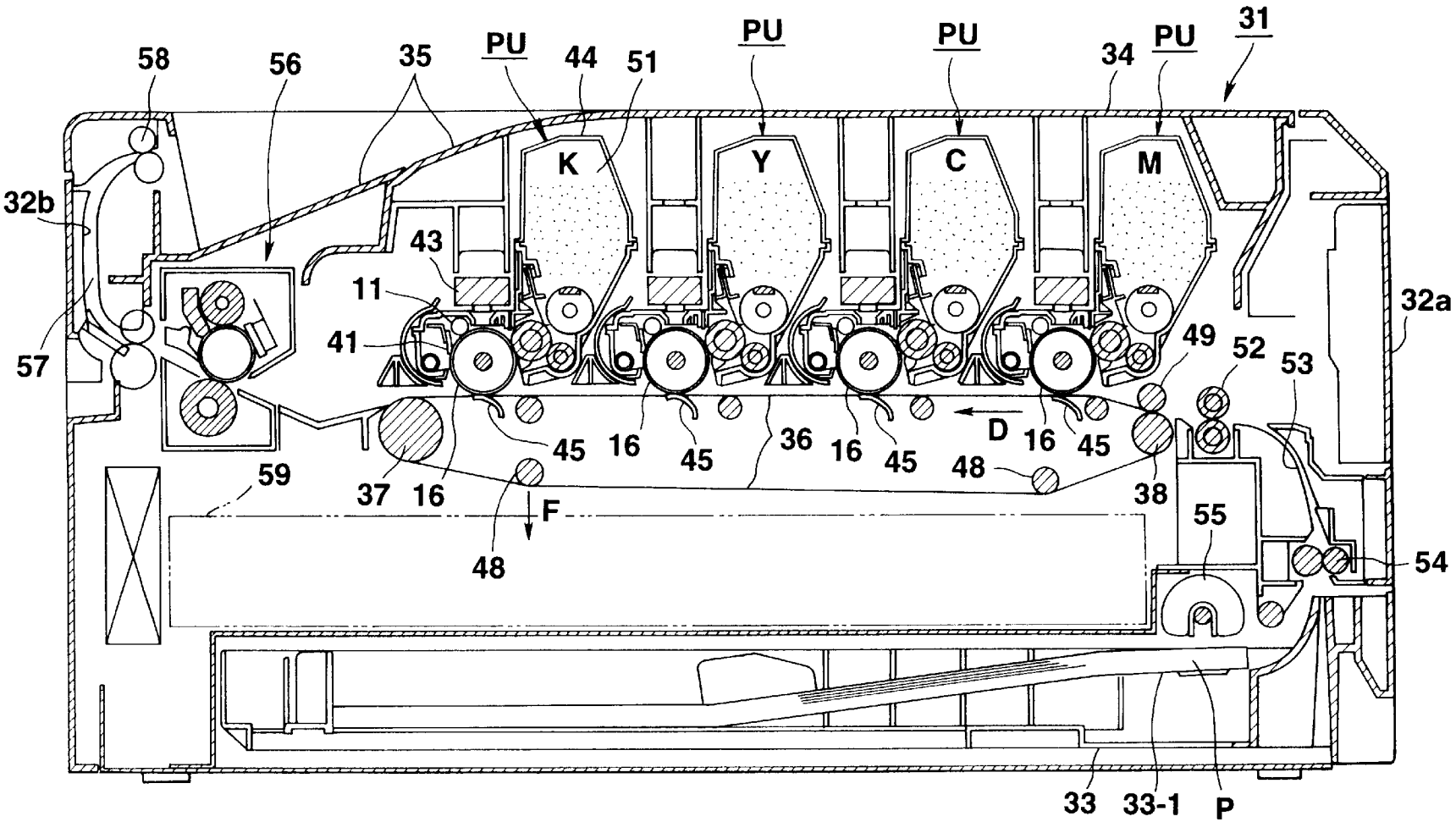
FIG. 6A is a schematic longitudinal sectional view of an electrophotographic image forming apparatus, the apparatus being provided with a plurality of image forming units each including the contact charging roller as the contact charging member according to one embodiment of the present invention.

FIG. 6A schematically shows a longitudinal sectional view of an electrophotographic color printer as the image forming apparatus according to one embodiment of the present invention. The printer 31 includes a manual paper sheet feed tray 32*a* provided to swing between a vertical closed position and a horizontal open position in a front wall of an outer housing of the printer 31, and an additional paper sheet discharge tray 32*b* provided to swing between a vertical closed position and a horizontal open position in a rear wall of the outer housing. A paper sheet cassette 33 is detachably provided in a bottom portion of the housing, and a large number of paper sheets P, each having a predetermined size, are stacked up on a bottom plate 33-1 urged upward by an urging member in the cassette. An upper wall of the housing is structured as a top cover 34 which is swingable upwardly and downwardly around its rear end between a horizontal closed position shown in FIG. 6A and a vertical open position. On a front end portion of an upper surface of the top cover 34, a power switch, a liquid-crystal display device, input keys, etc. (which are not shown) are provided. A rear end portion of the top cover 34 constitutes a main paper sheet discharge tray 35 which is inclined downwardly toward the rear end.

A paper sheet conveyor belt 36 extending substantially horizontally in a back and forth direction is arranged in a center of the inner space of the housing. The conveyor belt 36 is stretched between a driving roller 37 and a driven roller 38 arranged at two predetermined positions spaced apart from each other in the back and forth direction in the inner space, and is driven by the driving roller 37 to be circulated in an anti-clockwise direction as shown by an arrow D in FIG. 6A.

Four image forming units PU are arranged at equal intervals along an upper extending portion of the belt 36 in the inner space of the outer housing. The four image forming units PU have the same structure as to each other, and each of the units includes a photosensitive drum 16 which is an image carrier as a member to be charged uniformly by a contact charging roller 11 as a contact charging member described later.

Figure 6B:
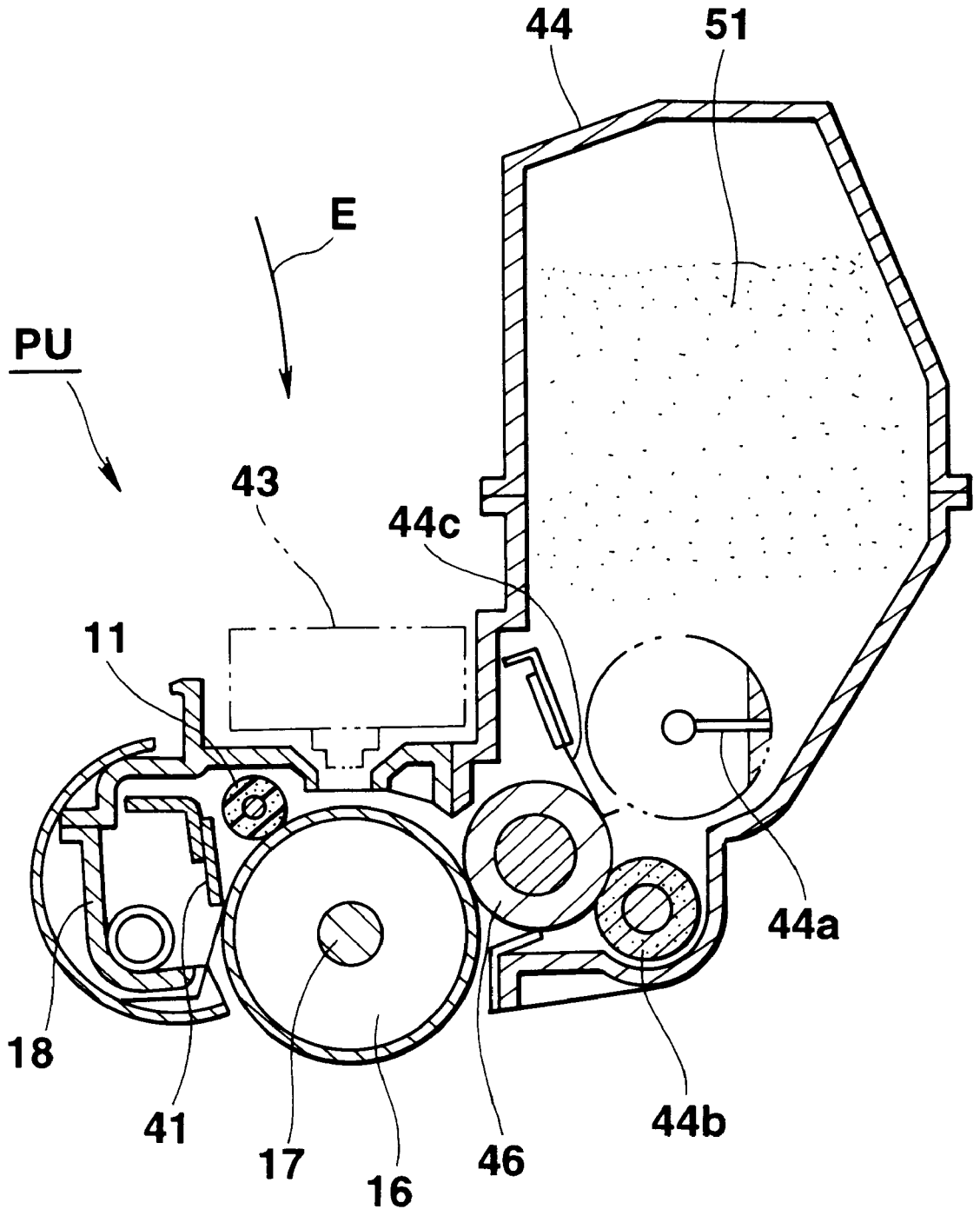
FIG. 6B is an enlarged schematic longitudinal sectional view of one of the image forming units shown in FIG. 6A.
Figure 7A:
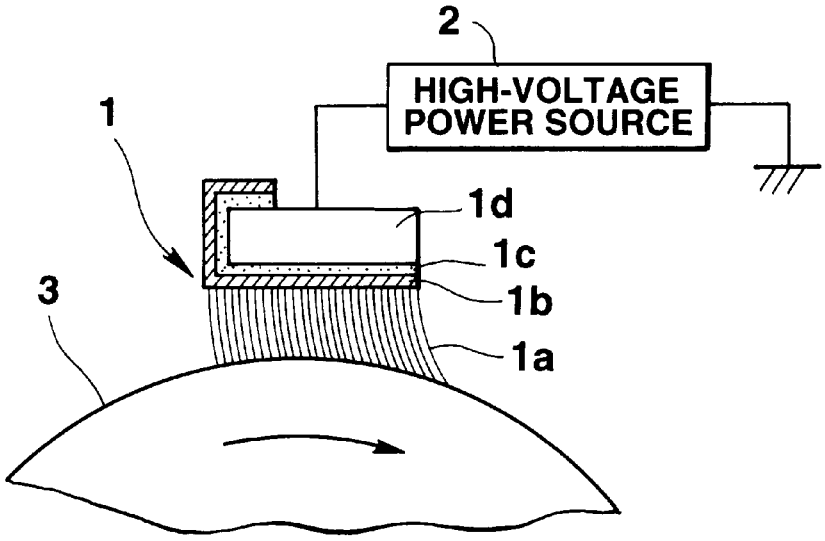
FIG.7A (PRIOR ART)
FIG. 7A is an enlarged schematic sectional view of a conventional brush-shaped contact charging member in a state that it is in contact with a cylindrical surface of a photosensitive drum as a member to be charged by the brush-shaped contact charging member.
Figure 7B:
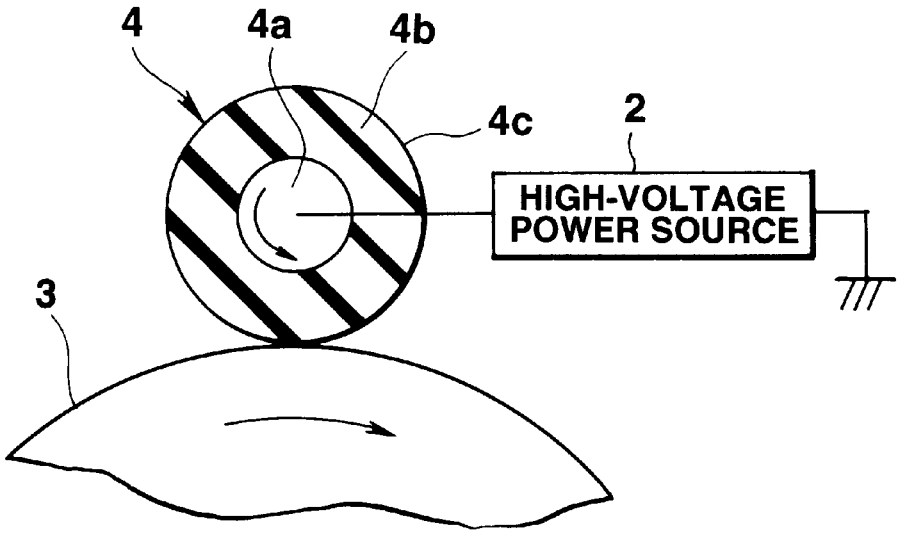
FIG.7B (PRIOR ART)
FIG. 7B is an enlarged schematic sectional view of a conventional roller-shaped contact charging member in a state that it is in contact with a cylindrical surface of a photosensitive drum as a member to be charged by the roller-shaped contact charging member.

FIG. 6B shows an enlarged longitudinal sectional view of one of the image forming units PU. As shown in FIG. 6B, the image forming unit includes a cleaner 41, a contact charging roller 11, a writing head 43, and a developer 44 those of which are arranged around the drum 16 with excepting a position corresponding to a lower end of the circular surface of the drum 16.

The cleaner 41, the contact charging roller 11, the writing head 43, and the developer 44 are arranged in this order around the drum 16 in the clockwise direction in FIG. 6B, and are, excluding the writing head 43, supported by a common unit frame, together with the photosensitive drum 16.

The four writing heads 43 of the four image forming units PU are fixed at four predetermined positions on a lower surface of the top cover 34 of the housing, and move upwardly and downwardly by the swing of the top cover 34 upwardly and downwardly. When the top cover 34 is swung upwardly from the closed position shown in FIG. 6A to the open position, the four writing heads 43 are moved upwardly from their predetermined positions in the four units, each of the predetermined positions being located between the contact charging roller 11 and the developer 44 around the drum 16 corresponding thereto, as shown by two dots-chain line in FIG. 6B. With such a structure, the four image forming units PU excluding the four writing heads 43 can be removed from the four predetermined positions in the housing for easy maintenance, repair, or replacement.

In operation of each image forming unit, while the photosensitive drum 16 is rotated in one time, the cleaner 41 clears the circular surface of the drum, the contact charging roller 11 electrically charges the surface of the drum uniformly with high minus electric charge, the writing head 43 projects light beam on the electrically charged surface of the drum to form an electrostatic latent image with low minus electric charge in accordance with a writing data inputted in control unit (described later) of the printer by the above described input keys on the top cover 34 or by a host computer (described later) connected to the control unit of the printer, and the developer 44 develops the latent image on the surface of the drum with a toner into a toner image.

The four developers 44 of the four image forming units contain toners 51 of different colors, and particularly in this embodiment the developers 44 contain the toners 51 of magenta M, cyan C, yellow Y, and black K in an order that the developers 44 are arranged along the upper extending portion of the conveyor belt 36 in its predetermined moving direction "D".

Each of the developers 44 includes a toner. stirring device 44*a*, a toner supply roller 44*b*, a developing roller 46 and a doctor blade 44*c*. The toner stirring device 44*a* stirs the toner 51 contained in the developer 44, the toner supply roller 44*b* supplies the stirred toner to the developing roller 46, the developing roller brings the toner into contact with the circular surface of the drum 16 to develop the latent image formed on the surface as described above, and the doctor blade 44*c* removes a residual toner stuck on the developing roller 46.

As shown in FIG. 6A, the paper sheet conveyor belt 36 always keeps its tension at a suitable value because a lower extending portion of the belt is urged downwardly by tension rollers 48, so that the upper surface of the upper extending portion of the conveyor belt 36 is stretched between the driving and driven rollers 37 and 38 without any waves to be always in contact with the lower ends of the photosensitive drums 16 of the four image forming units. Further, the belt 36 is pressed upwardly at four positions on the lower surface of its upper extending portion by four elastic transfer members 45, the four positions being corresponding to the lower ends of the four photosensitive drums 16. With such a structure, the four positions on the upper surface of the upper extending portion of the conveyor belt 36 which corresponding to the lower ends of the four photosensitive drums 16 are in contact with the lower ends of the four drums and make four image transfer portions in the printer 31, and the four elastic transfer members 45 constitute four image transfer devices.

The electrophotographic color printer 31 shown in FIG. 6A further includes a recording medium supply device which supplies the paper sheet P as one kind of the recording medium from the paper cassette 33 in the bottom of the inner space of the outer housing to an upstream end of the upper extending portion of the conveyor belt 36, the upstream end being corresponding to the driven roller 38, in the center of the inner space, and further supplies the paper sheet P to the above described four image transfer portions on the upper surface of the upper extending portion of the belt 36 by using the belt.

The recording medium supply device includes a recording medium supply path 53 extending upwardly from a front end of the paper cassette 33 to the upstream end of the upper extending portion of the conveyor belt 36 along a curved trace directing a top of its curve toward the front wall of the housing. A pickup roller 55 is arranged near to an entrance of the supply path 53 to correspond to the front end of the paper cassette 33. In a downstream side of the pickup roller 55 along the supply path 53, a pair of feed out rollers 54 are arranged. In a downstream side of the paired feed out rollers 54 along the supply path 53, that is an exit of the supply path 53, a pair of waiting rollers 52 are arranged. Further, a press roller 49 arranged near to the paired waiting rollers 52 is pressed on the upstream end of the upper extending portion of the conveyor belt 36.

The electrophotographic color printer 31 shown in FIG. 6A further includes a recording medium discharge device which discharges the paper sheet from a downstream end of the upper extending portion of the conveyor belt 36, the downstream end being corresponding to the driving roller 37, in the center of the inner space, toward the additional paper sheet discharge tray 32*b* in the rear wall of the outer housing or the main paper sheet discharge tray 35 in the top cover 34 of the housing. The discharge device includes a recording medium discharge path 57 extending from the downstream end of the upper extending portion of the conveyor belt 36 to the main paper sheet discharge tray 35 through the additional paper sheet discharge tray 32*b* along a curved trace directing a top of its curve rearward. A paper sheet separation member (not shown) is arranged near to the downstream end of the upper extending portion of the conveyor belt 36, that is near to an entrance of the discharge path 57. An image fixing device 56 is arranged between the downstream end of the upper extending portion of the conveyor belt 36 and the additional discharge tray 32*b* along the discharge path 57, and a pair of pull out rollers 58 are arranged at an exit of the discharge path 57 to forcibly pull out the paper sheet from the exit of the path 57 to the main discharge tray 35.

The electrophotographic color printer 31 shown in FIG. 6A further includes a control unit 59 in the inner space of the outer housing between the paper sheet conveyor belt 36 located at the center of the inner space and the paper cassette 33 located at the bottom of the inner space. The control unit 59 has various electric and electronic circuits for controlling the operation of the printer 31.

The electrophotographic color printer 31 starts its operation when the above described power switch (not shown) is turned on, and printing data including a material of the paper sheet P to be used, the number thereof, a printing mode to be used, and the other information is inputted in the control unit 59 by the above described input keys on the top cover 34 of the printer 31 or by the host computer connected to the control unit 59.

At first, the uppermost one paper sheet in the large number of paper sheets P on the bottom plate 33-1 of the paper cassette 33 is supplied into the entrance of the recording medium supply path 53 by the pickup roller 55. The paired paper feed rollers 54 at the entrance of the path 53 pinches the paper sheet P picked up from the cassette 33 and feeds the paper sheet P toward the paired waiting rollers 52. The paper sheet P from the feed rollers 54 collides at its leading end with a contact line between the waiting rollers so that a skew thereof is amended, and the feeding of the paper sheet P by the feed rollers 54 is stopped temporally.

While temporarily stopping of the feeding of the paper sheet P, the circulation of the conveyor belt 36 by the driving roller 37 at a predetermined speed in the anti-clockwise direction as shown by an arrow D in FIG. 6A is started. Further, the photosensitive drums 16 and the developing rollers 46 which are provided in each of the four image forming units PU shown in FIG. 6B also start their predetermined rotations in the clockwise direction at a timing that the toner image formed on the drum 16 of each of image forming units PU will be transferred to the paper sheet P at each of the four image transfer portions while the paper sheet P will be conveyed on the conveyor belt 36.

After the waiting rollers 52 start their rotation, the paper sheet P is pressed on the upstream end of the upper extending portion of the conveyor belt 36 by the press roller 49, and the press roller 49 applies a paper attracting bias to the paper sheet P so that the paper sheet is electrostatically forcibly attracted oil the upper surface of the upper extending portion of the belt 36. As a result of this, the toner images of four colors formed by the four image forming units will surely be transferred at the four transfer portions to predetermined four positions on the paper sheet P without positional errors.

The paper sheet P on which at least one color toner image among the four color toner images have been transferred in accordance with the printing data is separated from the upper surface of the upper extending portion of the conveyor belt 36 at the downstream end by the separation member (not shown), and then is passed through the fixing device 56 at which the transferred at least one color toner image on the paper sheet P is fixed on the paper sheet P with heat applied to the toner image by the fixing device 56. The paper sheet P passed through the fixing device 56 is discharged from the discharge path 57 to the additional discharge tray 32*b* when the additional discharge tray is positioned at its horizontal open position (described above but not shown) or to the main discharge tray 35 when the additional discharge tray is positioned at its vertical closed position (described above and shown in FIG. 6A), and on the additional tray 32*b* the paper sheet. P is laid with the at least one color toner image fixed thereon facing upward or on the main discharge tray 35 the paper sheet P is laid with the at least one color toner image fixed thereon facing downward.

Figure 1A:
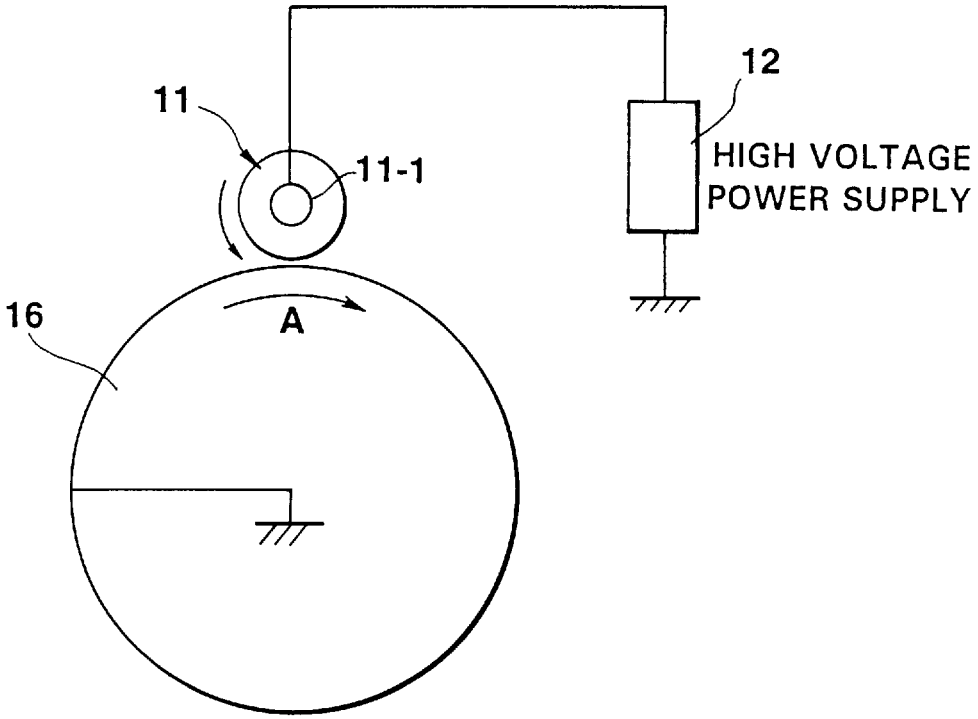
FIG. 1A is a side view schematically showing the structure of an image forming unit according to an embodiment and provided with a contact charging roller as a contact charging member according to an embodiment of the present invention.
Figure 1B:
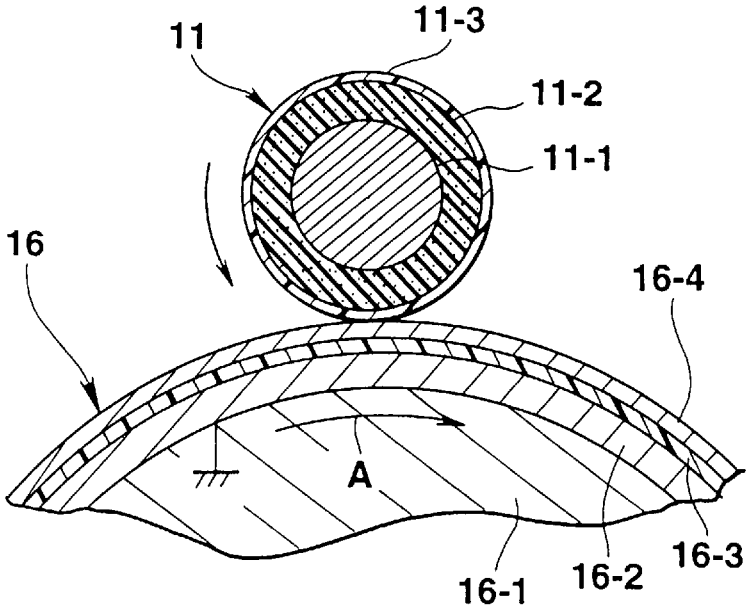
FIG. 1B is an enlarged cross sectional view schematically showing a cross section of the contact charging roller and that of a portion of a photosensitive drum against which the roller is pressed, the drum being an image carrier as a member to be charged by the contact charging member of the image forming unit shown in FIG. 1A.

As shown in FIG. 1B, the contact charging roller 11 of each of the four image forming units PU of the electrophotographic color printer 31 shown in FIG. 6A includes a round shaped metal bar 11-1 as a center member, a roller-shaped conductive foam material portion 11-2 covering the round bar, and a tube-shaped conductive resin material portion 11-3 covering the conductive foam material portion. And, as shown in FIG. 1A, a high voltage power supply 12 is connected to the round bar 11-1. The round bar is formed of a stainless steel and has a diameter of 6 mm. The conductive foam material portion 11-2 is made of a polyurethane foam which is formed by a reaction of polyol with isocyanate and includes carbon particles as conductive particles to make the foam material portion, have an electrical resistance of $10^3$ Ω. The conductive resin material portion 11-3 is made of conductive nylon tube which is formed by an extrusion molding to have a thickness of 100 μm and a surface resistance of $5\times10_6$ Ω/□.

The contact charging roller 11 as a whole has an outer diameter of 10 mm, a hardness of Asker F 80°, and an electrical resistance of $1\times10^6$ Ω.

Figure 2:
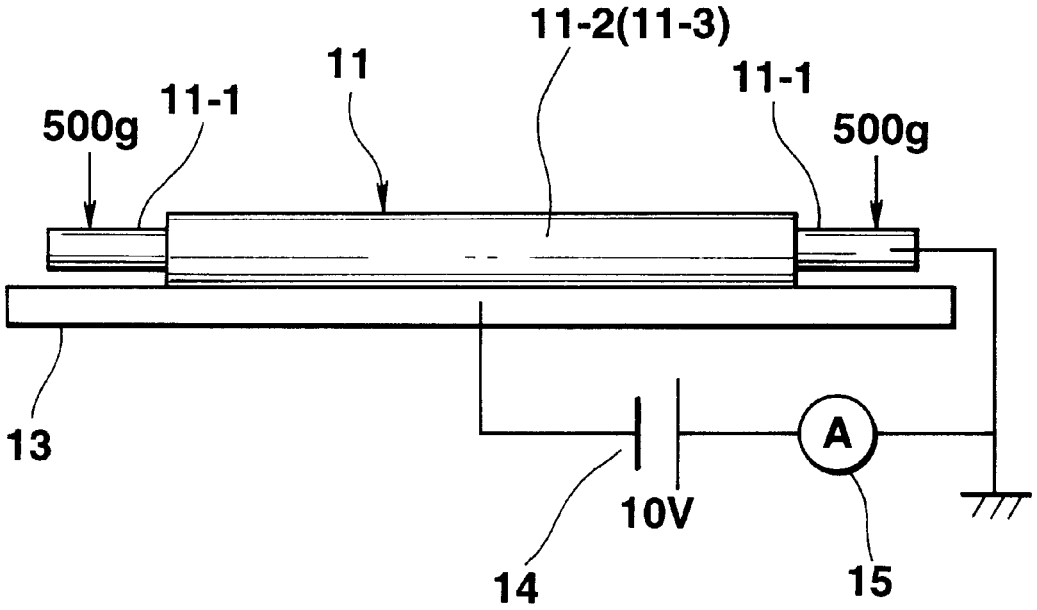
FIG. 2 is a schematic view showing an apparatus for measuring a surface resistance of the contact charging roller of FIG. 1A.

FIG. 2 shows an apparatus for measuring the surface resistance of the contact charging roller 11. In this measuring apparatus, a load of 500 g is applied to each of both ends of the metal rod 11-1, both ends being projected in the longitudinal direction of the roller 11 from the conductive foam and resin material portions 11-2 and 11-3, so that the circular surface of the roller is in contact with a measuring electrode 13. And, a power source 14 output of which is 10 V is connected to the measuring electrode 13 and the metal rod 11-1 through an ampere meter 15. At this time, the ampere meter 15 shows the resistance of $1\times10^6$ Ω as that of the contact charging roller 11.

Figure 3A:
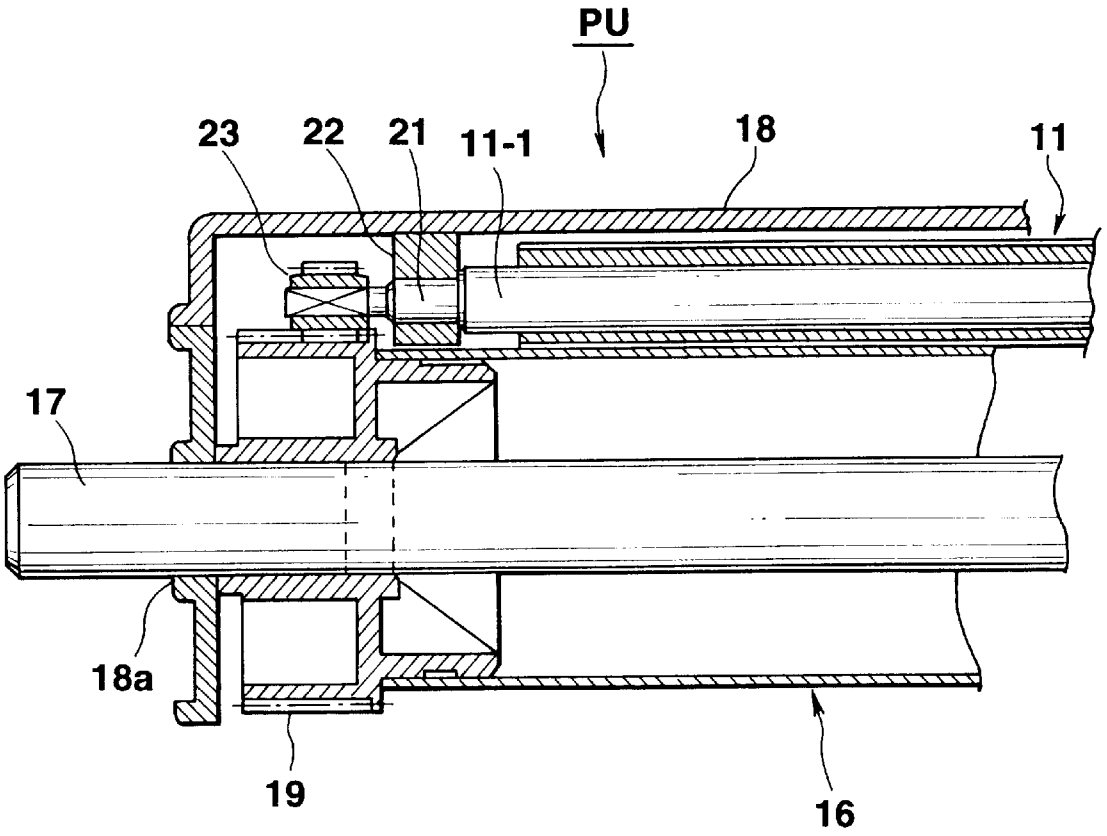
FIG. 3A is an enlarged longitudinal sectional view schematically showing an interengagement relationship between the contact charging roller and the photosensitive drum, the roller and the drum being provided in the image forming unit of the embodiment, and the roller being used as the contact charging member according to one embodiment of the present invention.
Figure 3B:
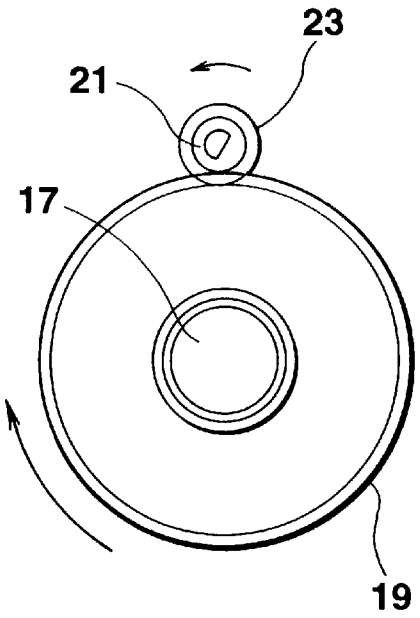
FIG. 3B is a schematic side view of the roller and the drum shown in FIG. 3A.

FIG. 3A schematically shows an interengagement relationship between the contact charging roller 11 and the photosensitive drum 16 in each of the four image forming units PU of the electrophotographic color printer 31 shown in FIG. 6A, and FIG. 3B schematically shows a side view of the charging roller 11 and the drum 16 shown in FIG. 3A.

As shown in FIGS. 3A and 3B, a drum supporting shaft 17 of the photosensitive drum 16 is rotatably supported at its ends by a pair of bearings 18*a* on the unit frame 18 (see FIG. 6B) of the image forming unit PU. A drum gear 19 is fixed to the drum supporting shaft 17 at one end of the photosensitive drum 16 and is selectably rotatably driven by a driving system (not shown) of the printer 31. Both ends 21 of the contact charging roller 11 are also rotatably supported by a pair of bearings 22 on the unit frame 18 (see FIG. 6B) of the image forming unit PU, and a pinion 23 fixed to one of the both ends 21 of the contact charging roller 11 is in mesh with the drum gear 19 so that the charging roller 11 is rotatably driven by the rotation of the drum gear 19.

Figure 3C:
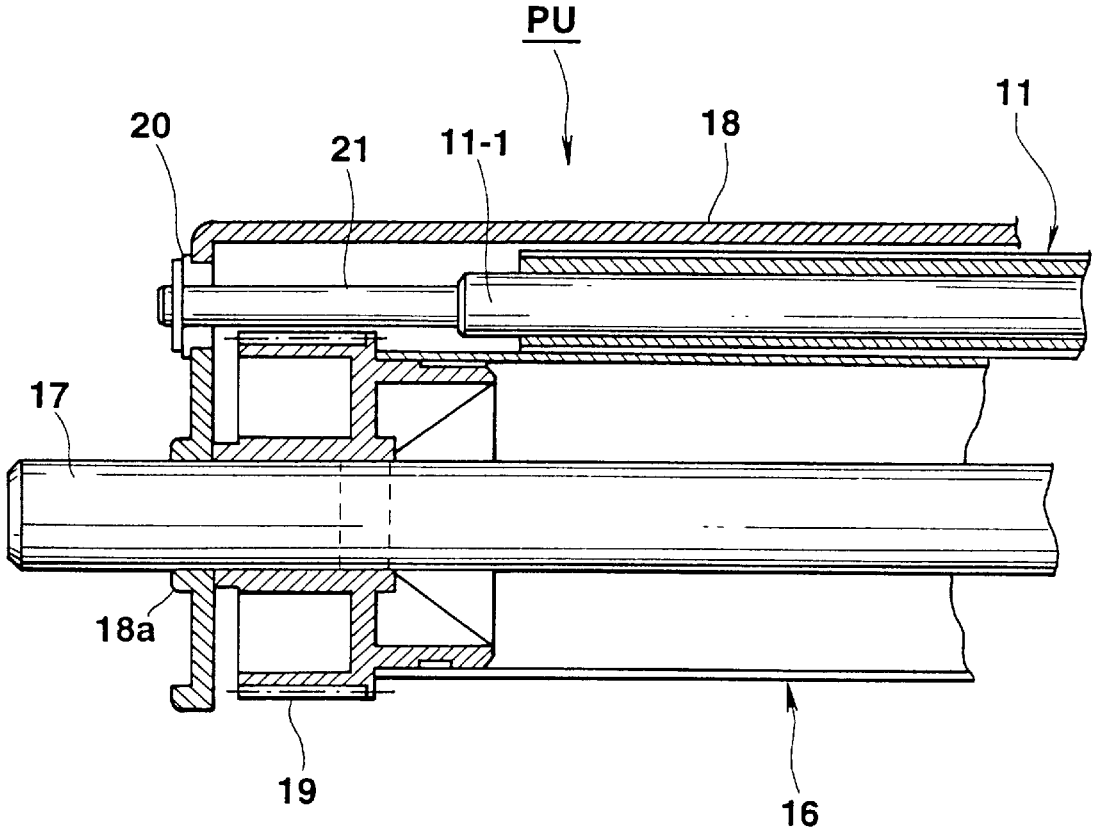
FIG. 3C is an enlarged longitudinal sectional view schematically showing a contact relationship between the contact charging roller and the photosensitive drum, the roller and the drum being provided in an image forming unit according to a modification of the present invention, and the roller being used as the contact charging member according to one embodiment of the present invention.

Alternatively, as shown in FIG. 3C, the contact charging roller 11 may be rotatably driven by the rotation of the drum gear 19 through a friction produced between the surface of the roller 11 and the circular surface of the drum 16. In this modification, one of the both ends 21 of the contact charging roller 11 does not have the pinion 23 which is employed in the above described one embodiment, and the above describe(d one of the both ends 21 of the contact charging roller 11 is only rotatably supported by a bearing 20 provided on the frame 18. A structure for a contact relationship between the contact charging roller 11 and the photosensitive drum 16 in the modification shown in FIG. 3C is simpler than that for an interengagement relationship therebetween in the above described one embodiment shown in FIGS. 3A and 3B.

In each of the four image forming units PU of the printer 31 of the present embodiment, the contact charging roller 11 is pressed against the cylindrical surface of the drum 16 so that the charging roller 11 bites its surface into the cylindrical surface of the drum 16 by 0.4 mm. And the high voltage power source 12 applies a charging voltage which is produced by superposing a direct current voltage $V_{DC}$ (about −700 V) on an alternating voltage $V_{AC}$ (a frequency of which is about 1300 Hz) having peak-to-peak voltage $V_{PP}$ of about 1400 V to about 1500 V to the metal center rod 11-1, so that a charged potential of the cylindrical surface of the drum 16 is set at about −650 V.

After the cylindrical surface of the drum 16 is charged uniformly as described above by the contact charging roller 11, an image is formed, for example halftone dots which are uniform over its whole area, on the recording paper, and a very fine quality of halftone dots image can be obtained. That is, there is no fault in the image on the recording paper. More specifically, not only a white belt or line will not formed on a center portion of the image, the center portion corresponding to the longitudinal center portion of the cylindrical surface of the photosensitive drum 16 from which the longitudinal center portion of the contact charging roller 11 is left by the bending of the charging roller, but also a lot of white spots will not formed on a whole of the image, the white spots caused by an insufficient contact of the charging roller 11 to the cylindrical surface of the photosensitive drum 16.

In this embodiment, the photosensitive drum 16 includes a conductive drum base 16-1 formed of an aluminum, an anodized aluminum layer 16-2 formed on the conductive drum base 16-1 to have a thickness of 5 $\mu$m, an under coat layer 16-3 of synthetic resin formed on the anodized aluminum layer 16-2 to have a thickness of 2 $\mu$m, and a photosensitive layer 16-4 formed on the under coat resin layer 16-3. A whole resistance of the anodized aluminum layer 16-2 and the under coat resin layer 16-3 is set high, for example in a range from $10^9$ Ω to $10_{10}$ Ω, so that it does not lower characteristics (for example, a charging characteristic and a photoconductivity when the drum is exposed by light) of the photosensitive drum 16. The above described high resistance prevents electric charges with high voltage uniformly charged on the photosensitive layer 16-4 by the contact charging roller 11 and transportation charges with low voltage formed in the uniformly charged electric charges by exposing at least a portion of the uniformly charged electric charges with light, from escaping from the photosensitive layer 16-4. Further, since the anodized aluminum layer 16-2 has a very high hardness, even if the cylindrical surface of the photosensitive drum 16 is damaged, the anodized aluminum layer 16-2 and the conductive drum base 16-1 will not be damaged.

In the following, how the above described arrangement and structure of the contact charging roller 16 according to one embodiment of the present invention are set will be described in detail.

At first, another contact charging roller having the same structure and size as those of the contact charging roller 16 according to one embodiment of the present invention, but being different from the charging roller 16 in its hardness is prepared. More specifically, the hardness of the another contact charging roller as a whole is Asker C 45° which is the same as that of the aforementioned conventional contact charging roller as a whole described in Japanese Patent No. 2,632,899, and the hardness of the contact charging roller 16 according to one embodiment of the present invention is Asker F 80° as described above. It is noted that the Asker C is used for designating a hardness of something which has a relatively high hardness, the Asker F is used for designating a hardness of something which has a relatively low hardness, and the hardness of something which has a relatively low hardness will not be measured by the Asker C. Next, the another contact charging roller is installed in an image forming unit of a printer, a structure of the image forming unit being the same as that of the image forming unit PU shown in FIG. 6B and according to one embodiment of the present invention, and the printer having only one image forming unit described above.

And, by using the printer, image forming operations are conducted many times, changing an amount of bite of the another contact charging roller into the cylindrical surface of the photosensitive drum. FIG. 4A shows printing qualities obtained by the printer with changing the amount of bite. In order to compare to this, FIG. 4A further shows printing qualities obtained by a printer in which only one image forming unit is used and this image forming unit is the same as the image forming unit PU shown in FIG. 6B and using the contact charging roller 11 according to one embodiment of the present invention.

In FIG. 4A, the printer using the contact charging roller 11 (Asker F–80°) can get good printing qualities in cases that the amount of bite is set at 0.2 mm, 0.4 mm, and 0.7 mm, but not at 0 mm because many white spots are formed in the image due to an insufficient contact of the contact charging roller 11 against the cylindrical surface of the drum 16. In contrast to this, the printer using the another contact charging roller (Asker C–45°) can not get good printing qualities in all cases that the amount of bite is set at 0 mm, 0.2 mm, 0.4 mm, and 0.7 mm because many white spots are formed in the image due to the insufficient contact of the whole of the another contact charging roller against the cylindrical surface of the drum 16 in the cases that the amount of bite is set at 0.1 mm and 0.2 mm, and a white belt or line is formed in the image due to the insufficient contact of the longitudinal center portion of the another contact charging roller against the cylindrical surface of the drum 16 caused by bending of the another contact charging roller.

In order to make the contact charging roller 11 have a good charging characteristic, that is to make the printer using that contact charging roller 11 have a good printing quality, both of the resistance of the conductive resin material portion 11-3 and that of the conductive foam material portion 11-2 must be set in suitable ranges, respectively. And this range is determined by an experiment performed by the inventors of the present invention. FIG. 4B shows a result of the experiment, and more specifically shows a relationship between the charging characteristic of the contact charging roller 11, that is the printing quality of the image formed on the recording paper by the printer, a change of the surface resistance of the tube-like conductive resin material portion 11-3, and a change of the resistance of the conductive foam material portion 11-2.

As shown in FIG. 4B, a good charging characteristic of the contact charging roller 11, that is the good printing quality of the image formed on the recording paper by the printer, is obtained when the surface resistance of the conductive resin material portion 11-3 is in a range from $1\times10^5$ Ω/□ or more to $9\times10^7$ Ω/□ or less and the resistance of the conductive foam material portion 11-2 is in a range of $9\times10^5$ Ω/□ or less, preferably $9\times10^4$ Ω/□ or less. And, the conductive resin material portion 11-3 having the surface resistance of the $10^4$ Ω/□ or less can not be realized because it must contain too much carbon particles to form the resilient conductive resin material portion 11-3.

Figure 5:
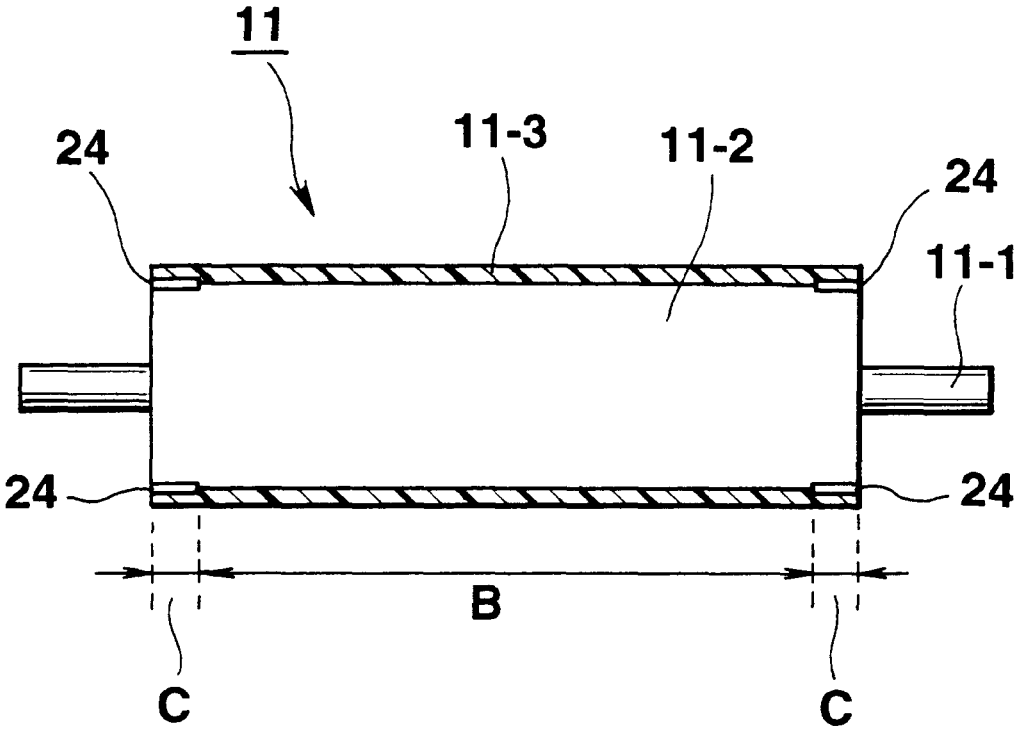
FIG. 5 is a schematic longitudinal sectional view showing a method for fixing the tube-shaped conductive resin material portion to the roller-shaped conductive foam material portion covering the center rod in the contact charging roller as the contact charging member according to one embodiment of the present invention.

FIG. 5 shows a method by which the tubular-shaped conductive resin material portion 11-3 is fixed to the conductive foam material portion 11-2 not to influence the good charging characteristic of the contact charging roller 11. According to this method, both longitudinal ends C of the tubular-shaped conductive resin material portion 11-3 are fixed to both longitudinal ends 24 of the cylindrical surface of the conductive foam material portion 11-2 by an adhesive, and the both longitudinal ends 24 of the circular surface of the conductive foam material portion 11-2 are arranged outside a center portion B of the cylindrical surface which corresponds to an image formation area on the cylindrical surface of the photosensitive drum 16 (shown in FIG. 1B). That is, both longitudinal ends C correspond to both longitudinal ends 24 of the cylindrical surface of the foam material portion 11-2 and further correspond to image-free areas arranged in both outsides of the image formation area on the cylindrical surface of the drum 16. And, by preparing the tube-like conductive resin material portion 11-3 independent of the conductive foam material portion 11-2 on the center rod 11-1 and by fixing the tube-like conductive resin material portion to the cylindrical surface of the conductive foam material portion 11-2 with the adhesive, even if the contact charging roller 11 having the two layers, that is the conductive foam material portion 11-2 and the conductive resin material portion 11-3, the contact charging roller 11 can be formed easily and cheaply.

As described above in detail, in the present invention, since the hardness of the contact charging roller as a whole is set at Asker F 90° or less, the contact charging roller can be in contact with the cylindrical surface of the image carrier uniformly even if the roller is formed to have a smaller diameter than that of the conventional one, so that the contact charging roller of the present invention can charge the cylindrical surface of the image carrier uniformly to make the image carrier have the good image, and the image forming unit using the contact charging roller and the electrophotographic image forming apparatus can be formed to have a small outer size.

And, since the image carrier of the image forming unit of the present invention has an anodized aluminum layer as a blocking layer and the photosensitive layer provided on the anodized aluminum layer, further since the image carrier of the one embodiment of the present invention has an undercoat resin layer as an additional blocking layer provided on the anodized aluminum layer but under the photosensitive layer, withstand voltage of the image carrier is increased and a leak of charges from the image carrier is prevented, so that a durability of the image carrier is increased with maintaining the good image forming performance thereof.

Further, in the present invention, since the tubular-shaped conductive resin material portion has both end areas corresponding to the image-free areas of the image carrier outside of its image-forming area and is fixed at the both end areas to the roller-shaped conductive foam material portion by an adhesive, a preparation of the conductive charge roller is easy and will not influence the image forming quality formed on the image carrier.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A contact charging member provided on a center member, comprising:

a conductive foam material portion covering the center member and having an electrical resistance of $9\times10^5$ Ω or less; and a conductive resin material portion covering the conductive foam material portion and in contact with a member to be charged by the contact charging member, the conductive resin material portion including conductive agents and having a surface electrical resistance between $1\times10^5$ Ω/□ and $9\times10^7$ Ω/□, and a hardness of the contact charging member being Asker F 90° or less.

2. A contact charging member according to claim 1, wherein:

the conductive foam material portion has a roller-shape, the conductive resin material portion has a tubular-shape, and the contact charging member has a roller-shape.

3. A contact charging member according to claim 2, wherein:

the member to be charged is an image carrier including a surface having an image formation area on which an image is formed and image-free areas arranged outside of the image formation area, the tubular-shaped conductive resin material portion has both ends corresponding to the image-free areas of the image carrier and is fixed at both ends to the roller-shaped conductive foam material portion by an adhesive.

4. An image forming unit comprising:

an image carrier; and a contact charging member which is in contact with a surface of the image carrier and electrically charges the surface of the image carrier uniformly, the contact charging member being provided on a center member and including a conductive foam material portion which covers the center member and has an electrical resistance of $9\times10^5$ Ω or less, and a conductive resin material portion which covers the conductive foam material portion and is in contact with the image carrier, the conductive resin material portion including conductive agents and having a surface electrical resistance between $1\times10^5$ Ω/□ and $9\times10^7$ Ω/□, and a hardness of the contact charging member being Asker F 90° or less.

5. An image forming unit according to claim 4, wherein:

the conductive foam material portion of the contact charging member has a roller-shape, the conductive resin material portion of the contact charging member has a tubular-shape, the contact charging member has a roller-shape, and the image carrier has a drum-shape.

6. An image forming unit according to claim 5, wherein:

the image carrier includes a surface having an image formation area on which an image is formed and image-free areas arranged outside of the image formation area, the tubular-shaped conductive resin material portion has both ends corresponding to the image-free areas of the image carrier and is fixed at both ends to the roller-shaped conductive foam material portion by an adhesive.

7. An image forming unit according to claim 5, wherein the drum-shaped image carrier is rotatably driven, and the roller-shaped contact charging member is rotated by the rotation of the drum-shaped image carrier through friction produced between the surface of the conductive resin material portion of the roller-shaped contact charging member and that of the drum-shaped image carrier.

8. An image forming unit according to claim 5, wherein the image carrier includes an aluminum drum having an anodized aluminum layer provided on an outer surface thereof and a photosensitive material layer provided on the anodized aluminum layer.

9. An electrophotographic image forming apparatus, comprising:

an image carrier which includes a photosensitive drum having a cylindrical surface;

a roller-shaped contact charging member which is in contact with the cylindrical surface of the photosensitive drum and electrically charges the cylindrical surface of the photosensitive drum uniformly;

an exposure device which exposes the uniformly charged cylindrical surface of the photosensitive drum with a desired image;

a developing device which develops the exposed desired image on the cylindrical surface of the photosensitive drum;

a recording medium supply device which supplies a recording medium toward the developed desired image on the cylindrical surface of the photosensitive drum;

a transfer device which transfers the developed desired image from the cylindrical surface of the photosensitive drum to the supplied recording medium; and a recording medium discharge device which discharges the recording medium on which the developed desired image has been transferred, from the cylindrical surface of the photosensitive drum, the roller-shaped contact charging member being provided on a center member and including:

a roller-shaped conductive foam material portion which covers the center member and has an electrical resistance of $9\times10^5$ Ω or less; and a tubular-shaped conductive resin material portion which covers the conductive foam material portion and is in contact with the image carrier, the conductive resin material portion including conductive agents and having a surface electrical resistance between $1\times10^5$ Ω/□ and $9\times10^7$ Ω/□, and a hardness of the contact charging member being Asker F 90° or less.

10. An electrophotographic image forming apparatus according to claim 9, wherein:

a cylindrical surface of the photosensitive drum has an image formation area on which an image is formed and image-free areas arranged outside of the image formation area, the tubular-shaped conductive resin material portion of the roller-shaped contact charging member having both ends corresponding to the image-free areas of the photosensitive drum and is fixed at both ends to the roller-shaped conductive foam material portion by an adhesive.

11. An electrophotographic image forming apparatus according to claim 9, wherein:

the photosensitive drum is rotatably driven, and the roller-shaped contact charging member is rotated by the rotation of the photosensitive drum through friction produced between the surface of the conductive resin material portion of the roller-shaped contact charging member and the cylidrical surface of the photosensitive drum.

12. An electrophotographic image forming apparatus according to claim 9, wherein the photosensitive drum includes an anodized aluminum layer provided on an outer surface thereof and a photosensitive material layer provided on the anodized aluminum layer.

* * * * *